US007020213B2

(12) United States Patent
Kunikata

(10) Patent No.: US 7,020,213 B2
(45) Date of Patent: Mar. 28, 2006

(54) METHOD AND APPARATUS FOR SELECTIVELY PROVIDING DIFFERENT ELECTRIC SIGNAL PATHS BETWEEN CIRCUITS

(75) Inventor: Norikazu Kunikata, Hachioji (JP)

(73) Assignee: TEAC Corporation, (JP)

( * ) Notice: Subject to any disclaimer, the term of this patent is extended or adjusted under 35 U.S.C. 154(b) by 744 days.

(21) Appl. No.: 10/034,830

(22) Filed: Dec. 26, 2001

(65) Prior Publication Data

US 2002/0085642 A1 Jul. 4, 2002

(30) Foreign Application Priority Data

Dec. 28, 2000 (JP) ..... 2000-400435
Apr. 9, 2001 (JP) ..... 2001-110519
Sep. 19, 2001 (JP) ..... 2001-285224

(51) Int. Cl.
*H04K 1/10* (2006.01)

(52) U.S. Cl. ..... 375/260; 340/639; 340/426.25; 361/64; 700/12; 700/22; 341/110; 348/584

(58) Field of Classification Search ..... 375/260; 340/639, 426.25; 361/64; 700/12, 22; 341/110; 348/584

See application file for complete search history.

(56) References Cited

U.S. PATENT DOCUMENTS 4,694,344 A * 9/1987 Flora ..... 348/584
4,920,476 A * 4/1990 Brodsky et al. ..... 700/22
5,249,115 A * 9/1993 Reid ..... 700/12
5,892,449 A * 4/1999 Reid et al. ..... 340/639
5,909,180 A * 6/1999 Bailey et al. ..... 340/639
6,055,144 A * 4/2000 Reid ..... 361/64
6,100,792 A * 8/2000 Ogino et al. ..... 340/426.25
6,218,971 B1 * 4/2001 Sugihara ..... 341/110

FOREIGN PATENT DOCUMENTS

JP 11-215078 6/1999

* cited by examiner

*Primary Examiner*—Stephen Chin
*Assistant Examiner*—Sudhanshu C. Pathak
(74) *Attorney, Agent, or Firm*—Woodcock Washburn LLP

(57) ABSTRACT

A digital signal path selector is disclosed in its simplest form for selectively connecting two input terminals to two output terminals. Both input terminals and output terminals are laid out on a control panel, on which there are also provided two input select pushbuttons, positioned one adjacent each input terminal, and two output select pushbuttons positioned one adjacent each output terminal. The input select pushbuttons and the output select pushbuttons are arranged so close to one another that any one input select pushbutton and any one output select pushbutton are capable of concurrent depression with the thumb and forefinger of one hand in order to specify one associated input terminal and one associated output terminal for creation of a signal path therebetween. A digital signal processor cooperates with a read-only memory and random-access memory for creating the desired signal path between any specified input terminal and any specified output terminal to the exclusion of any preexisting signal path that might interfere with the creation of the new signal path. Another embodiment is disclosed in which the invention is applied to a digital mixer.

14 Claims, 12 Drawing Sheets

METHOD AND APPARATUS FOR SELECTIVELY PROVIDING DIFFERENT ELECTRIC SIGNAL PATHS BETWEEN CIRCUITS

BACKGROUND OF THE INVENTION

This invention relates to a method of, and apparatus for, selectively providing different paths for transmission of electric signals from one circuit to another. More specifically, the invention deals with a novel one-hand, finger-pressure actuation method of, and apparatus for, selective connection of a plurality of input means such as terminals to a plurality of output means such as terminals. The invention is believed to be best applicable to a digital mixer, although no unnecessary limitations to this particular application are intended.

In analog mixers, which were in widespread use before the advent of digital counterparts, the input terminals are incorporated with a module for processing the input signals. What is known as a patch bay is used for selective manual connection of the input terminals to the signal processing module. The patch bay, also known as patch board, is a board or panel having a multiplicity of jacks at which circuits are terminated. Patch cables are plugged into the jacks to provide temporary signal paths. The patch cables are cumbersome of handling, and the poor or wrong contact, or even noncontact at all, of the plugs and jacks has been very liable to occur.

These inconveniences are absent from digital mixers which dispense with patch cables by incorporating a microprocessor or a digital signal processor for signal path selection, as disclosed for example by Japanese Unexamined Patent Publication No. 11-215078. As heretofore constructed, however, digital mixers have not necessarily been easy of manipulation because of complex manipulative steps involved which, moreover, are totally different from the handling of patch cables on analog mixers. Another objection to the prior art digital mixers is the inadequacy of measures taken to enable the operator to visually observe the signal paths he or she is making, which has added to the difficulty of manipulation of these mixers.

SUMMARY OF THE INVENTION

The present invention has it as an object to defeat all the noted drawbacks of the prior art and to simplify and expedite the process of signal path selection in digital mixers or the like.

Briefly stated in one aspect thereof, the invention may be summarized as a method of selectively providing desired electric signal paths between a plurality of input means such as input terminals and a plurality of output means such as output terminals. The method comprises providing input select means and output select means capable of manual actuation for selecting any of a plurality of input means and any of a plurality of output means for creation of a signal path therebetween. The input select means and the output select means are constantly monitored to determine whether any of the input means and any of the output means are selected for creation of a signal path therebetween. Then, upon determination of the selection of any one input means and any one output means for creation of a signal path therebetween, a preexisting signal path, if any, between the selected input means and any unselected output means and between any unselected input means and the selected output means is canceled. Then is created the desired signal path between the selected input means and the selected output means.

Another aspect of the invention concerns a signal path selector for carrying the above summarized method into practice. It comprises a plurality of input means, a plurality of output means, input select means capable of manual actuation for selecting any of the input means for creation of a signal path to any selected output means, and output select means capable of manual actuation for selecting any of the output means for creation of a signal path from any selected input means. Also included are control means responsive to the actuation of the input select means and the output select means for creating the desired signal path between any selected input means and any selected output means to the exclusion of any preexisting signal path between the input means and the output means that might interfere with the creation of the desired signal path.

In the preferred embodiments of the invention to be set forth subsequently, both input select means and output select means take the form of pushbutton switches. All that the operator needs to do for creation of a desired signal path is to depress one input select pushbutton and one output select pushbutton. The desired signal path will then be created automatically to the exclusion of any preexisting interfering path.

Preferably, any one input select pushbutton and any one output select pushbutton are actuated simultaneously, as with the thumb and forefinger of one hand, rather than one after the other, for commanding a creation of a signal path therebetween. The simultaneous depression can then be utilized as additional information for specifying any desired signal path, reducing the manipulative steps required to that end. As an additional advantage, the one-hand, finger-pressure actuation of the pushbuttons is somewhat similar to the conventional patch cable connection of analog mixer terminals, so that the operator will readily get used to such manipulation of the pushbuttons according to the invention.

It is also recommended that some form of visual indicator means be provided for indicating which of the input means and which of the output means are selected by the input select means and the output select means for creation of a signal path therebetween. Light-emitting diodes are preferred examples of such visual indicator means. One LED may be positioned adjacent each input means and each output means. When one input means and one output means are concurrently chosen for connection, the two associated LEDs may be lit up under the direction of the control means, enabling the operator to visually confirm his or her choices. Such visual indicators are believed to materially facilitate the selective connection of the input and output means.

The above and other objects, features and advantages of this invention will become more apparent, and the invention itself will best be understood, from a study of the following description and appended claims, with reference had to the attached drawings showing the preferred embodiments of the invention.

DESCRIPTION OF THE PREFERRED EMBODIMENTS

Figure 1:
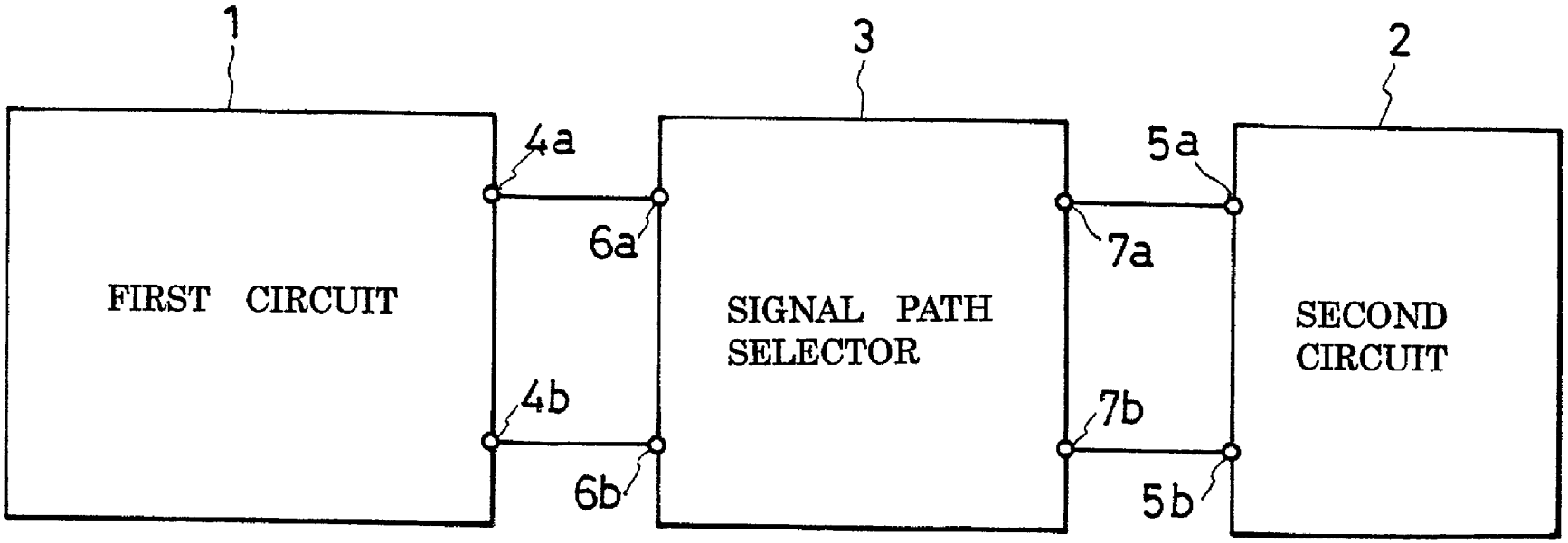
FIG. 1 is a block diagram explanatory of the first preferred embodiment of the invention, this embodiment being explanatory of the fundamental operating principles of the invention rather than representative of an actual working environment of the invention.

The present invention may be practiced in its simplest form as depicted in FIG. 1, showing a first circuit 1, a second circuit 2, and a signal path selector 3 constituting the gist of the invention. Connected between the circuits 1 and 2, the signal path selector 3 functions to selectively provide different signal paths therebetween. An example of the first circuit 1 is some source of multichannel analog audio signals, which is shown as having two output terminals 4*a* and 4*b* for putting out such signals. The second circuit 2 may then take the form of a multichannel recorder, complete with two analog input terminals 5*a* and 5*b*.

The signal path selector 3 is what may be termed a digital path bay, shown as having two input terminals 6*a* and 6*b* and two output terminals 7*a* and 7*b* for ease of disclosure and understanding. Of course, in practice, much greater numbers of such terminals may be provided. The signal path selector 3 is equipped, as will be subsequently disclosed with reference to the other drawings, for connection of the first input terminal 6*a*, and of the second input terminal 6*b*, exclusively to either of the output terminals 7*a* and 7*b*. It is envisaged within the broader scope of the invention that the signal path selector 3 be constructed either simply for selective signal transfer from input terminals 6*a* and 6*b* to output terminals 7*a* and 7*b*, or, despite its broad naming here, equipped to give mixing, equalization, or other special effects to the incoming signals.

Figure 2:
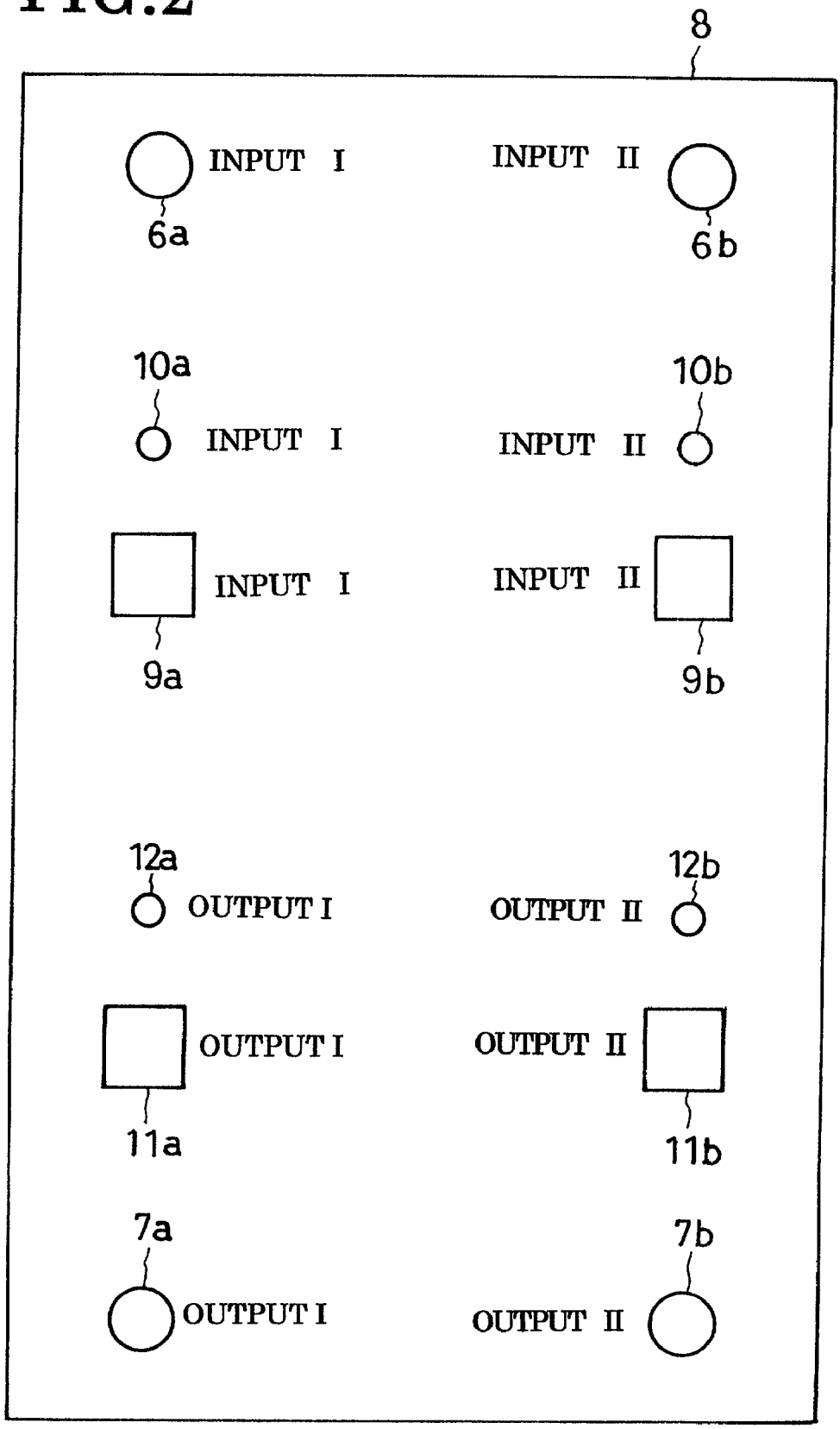
FIG. 2 is a plan view of explanatory nature showing the control panel of the signal path selector of FIG. 1.

The signal path selector 3 has a control panel shown in FIG. 2 and therein generally designated 8. In conformity with the two input terminals 6*a* and 6*b* and two output terminals 7*a* and 7*b*, the control panel 8 is shown to have two input select pushbuttons 9*a* and 9*b*, together with input select indicators 10*a* and 10*b*, and two output select pushbuttons 11*a* and 11*b* with output select indicators 12*a* and 12*b*. All the pushbuttons 9*a*, 9*b*, 11*a* and 11*b* constitute actuator parts of electric switches to be disclosed subsequently. Typically, the indicators 10*a*, 10*b*, 12*a* and 12*b* take the form of light-emitting diodes, glowing upon depression of the associated pushbuttons to help the operator visually confirm the connections he has made.

It will also be observed from FIG. 2 that the first input terminal 6*a*, first input select pushbutton 9*a* and first input select indicator 10*a* are positioned closer to one another than to any other such parts on the control panel 8. The second input terminal 6*b*, second input select pushbutton 9*b* and second input select indicator 10*b* are also positioned closer to one another than to any other such parts on the control panel 8. Likewise, the first output terminal 7*a*, first output select pushbutton 11*a* and first output select indicator 12*a* are positioned closer to one another than to any other such parts on the control panel 8. The second output terminal 7*b*, second output select pushbutton 11*b* and second output select indicator 12*b* are also positioned closer to one another than to any other such parts on the control panel 8. Further, as additional visual aids to manipulation of the control panel 8, the indicia "INPUT I," "INPUT II," "OUTPUT I," and "OUTPUT II," are marked next to the terminals, pushbuttons and indicators of the respective groups.

Hereinafter in this specification the term "object" will be used, where necessary, to refer to each group of terminals, pushbuttons and indicators on the control panel 8 with a view to the ease of disclosure and understanding of the invention. The first input terminal 6*a*, first input select pushbutton 9*a* and first input select indicator 10*a* constitute the first input object named "INPUT I". The second input terminal 6*b*, second input select pushbutton 9*b* and second input select indicator 10*b* constitute the second input object with the name "INPUT II". The first output terminal 7*a*, first output select pushbutton 11*a* and first output select indicator 12*a* constitute the first output object with the name "OUTPUT I". The second output terminal 7*b*, second output select pushbutton 11*b* and second output select indicator 12*b* constitute the second output object with the name "OUTPUT II".

Figure 3:
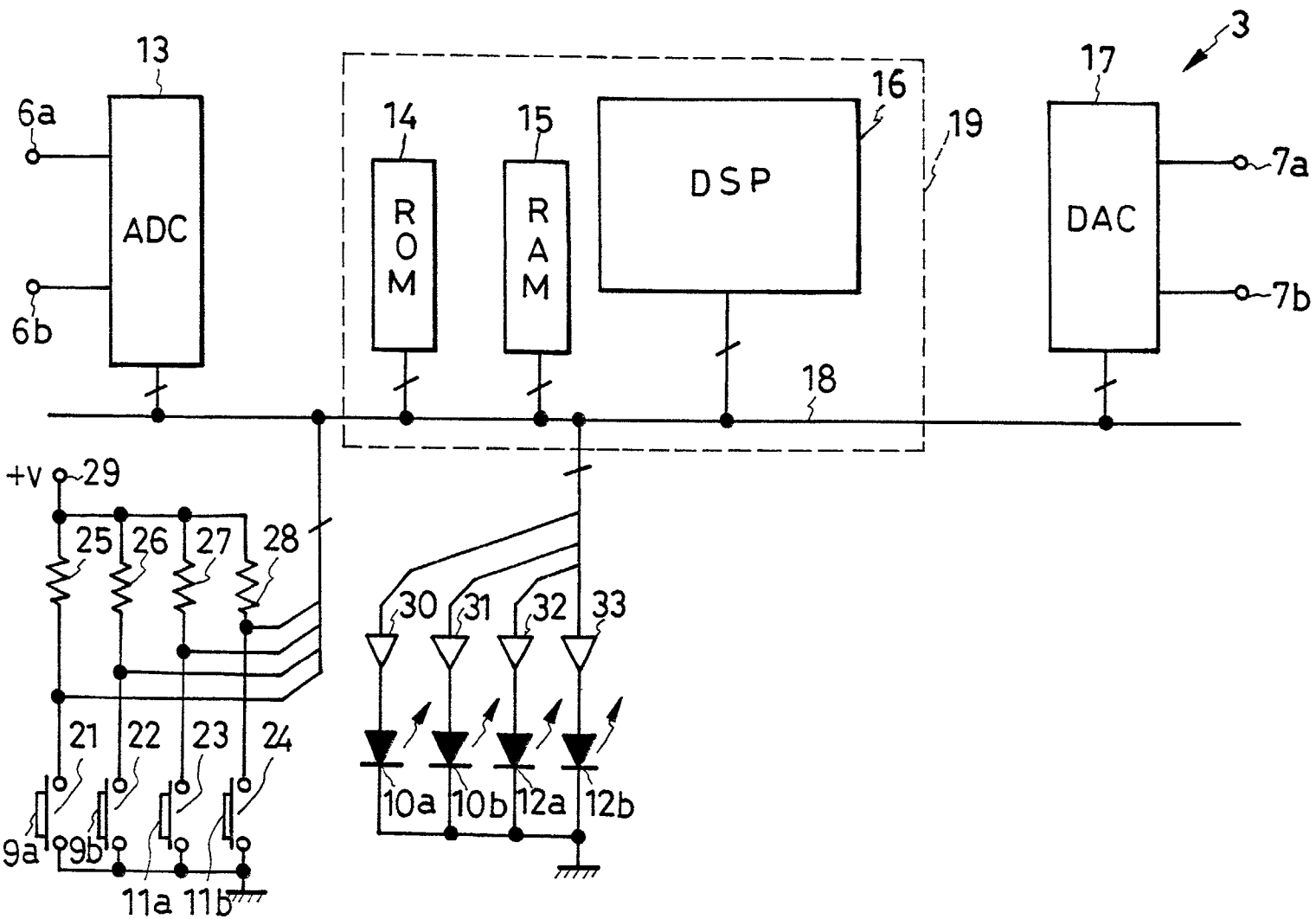
FIG. 3 is a schematic electrical diagram, partly in block form, showing the FIG. 1 signal path selector in more detail.

Reference may be had to FIG. 3 for a closer study of the signal path selector 1. It comprises, in addition to the means shown in FIG. 2, an analog-to-digital converter (ADC) 13, a preprogrammed read-only memory (ROM) 14, a random-access memory (RAM) 15, a digital signal processor (DSP) 16, a digital-to-analog converter (DAC) 17, and a bus 18. Having inputs connected to both first and second input terminals 6*a* and 6*b*, the ADC 13 digitizes the incoming analog audio signals for delivery to the DSP 16 over the bus 18.

The reference numeral 19 generally denotes the control means of the signal path selector 1 comprising the ROM 14, RAM 15 and DSP 16, which are all connected to the bus 18. The control means 19 control the process of signal path selection in response to the actuation of the input select pushbuttons 9*a* and 9*b* and output select pushbuttons 11*a* and 11*b*. In practice the control means 19 may take the form of a microcomputer with a central processor unit.

The functions of the control means 19 may be summarized and enumerated as follows:

1. To recognize the actuations of the input select pushbuttons 9*a* and 9*b* and output select pushbuttons 11*a* and 11*b* and how a signal path or paths are currently formed between the input terminals 6*a* and 6*b* and the output terminals 7*a* and 7*b*, that is, between INPUTS I and II and OUTPUTS I and II.

2. To determine the presence or absence of a preexisting connection or connections that might interfere with the creation of each desired new signal path from either of INPUT I and INPUT II, as specified by either of the input select pushbuttons 9*a* and 9*b*, to either of OUTPUT I and OUTPUT II as specified by either of the output select pushbuttons 11*a* and 11*b*, and, if there is any such potentially interfering preexisting connection, to cancel it.

3. To provide the desired signal path between the desired input object and the desired output object.

The DAC 17 inputs the digital signals sent from the DSP 16 over the bus 18. The analog equivalents of these digital signals are sent to the multichannel recorder 2, FIG. 1, or the like via the output terminals 7*a* and 7*b*.

As indicated also in FIG. 3, the input select pushbuttons 9*a* and 9*b* constitute the actuators of input select switches 21 and 22, respectively, whereas the output select pushbuttons 11*a* and 12*b* constitute the actuators of output select switches 23 and 24, respectively. All these switches 21–24 are connected to a supply terminal 29 via respective resistors 25-28 on the one hand and grounded on the other. The junctions between the switches 21–24 and the resistors 25–28 are all connected to the DSP 16 by way of the bus 18. Thus, when any of the switches 21–24 is actuated, the DSP is notified to that effect, and the information is stored on the RAM 15. It is understood that the DSP 16 conventionally operates at successive sampling moments.

In use of this signal path selector 3 the operator is to choose a desired signal path by concurrently pressing either of the input select pushbuttons 9*a* and 9*b* and either of the output select pushbuttons 11*a* and 11*b*. Such concurrent depression of two pushbuttons is possible by use of the thumb and forefinger of either hand, which is reminiscent of the handling of patch cables on the patch bay of the conventional analog mixer. An operator accustomed to the patch bay will readily get used to such manipulation of the pushbuttons on the digital signal path selector according to this invention.

Any desired combination of the input select pushbuttons 9*a* and 9*b* and output select pushbuttons 11*a* an 11*b* may simply be pressed concurrently for creation of a new signal path in cancellation of a preexisting one. Let it be supposed for instance that the first input select pushbutton 9*a* and second output select pushbutton 11*b* are pressed simultaneously, when a signal path preexists between first input terminal 6*a* and first output terminal 7*a*. This preexisting signal path will be cancelled automatically, and the desired path established instead between first input terminal 6*a* and second output terminal 7*b*.

It will also be observed from FIG. 3 that the input select indicators 10*a* and 10*b* and output select indicators 12*a* and 12*b* are all connected via respective driver circuits 30-33 to the bus 18 thereby to be connected to the DSP 16. These LED indicators can therefore be selectively made to glow in response to signals from the DSP 16 upon actuation of the associated pushbuttons. The operator can visually confirm that he or she has interconnected the first input terminal 6*a* and first output terminal 7*a* if the indicators 10*a* and 12*a* are both lit up.

Figure 4:
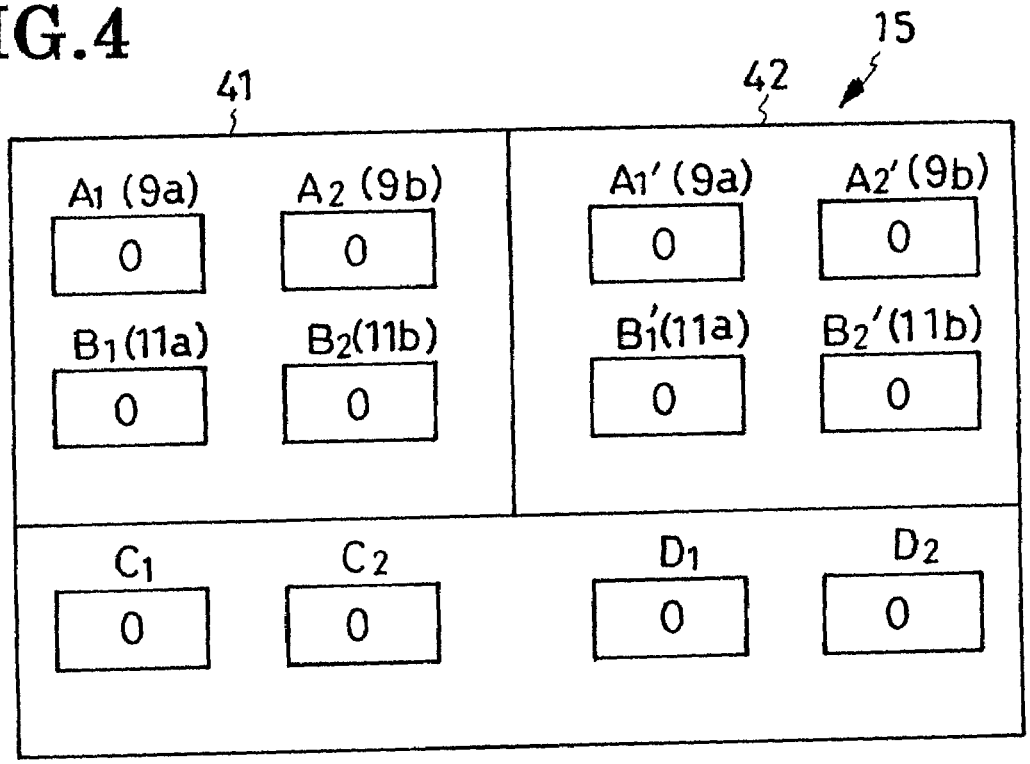
FIG. 4 is a diagram explanatory of the functions of the random-access memory included in the control means of the FIG. 3 signal path selector.

FIG. 4 diagrammatically illustrates the constitution of the RAM 15. Functionally speaking, the RAM 15 contains:

1. A current pushbutton status table 41 for storing data indicative of whether the pushbuttons 9*a*, 9*b*, 11*a* an 11*b* are depressed or not at the current sampling moment.

2. A previous pushbutton status table 42 for storing data indicative of whether the pushbuttons 9*a*, 9*b*, 11*a* and 11*b* were depressed or not at the preceding sampling moment.

3. An input object name region $C_1$ for storing an object name when a corresponding one of the input select pushbuttons 9*a* and 9*b* is depressed.

4. An output object name region $C_2$ for storing an object name when a corresponding one of the output select pushbuttons 11*a* and 11*b* is depressed.

5. A first destination object region $D_1$ for storing the object name to which is to be connected the INPUT I objects.

6. A second destination object region $D_2$ for storing the object name to which is to be connected the INPUT II objects.

More specifically, the current pushbutton status table 41 is constituted of two input select pushbutton status regions $A_1$ and $A_2$ and two output select pushbutton status regions $B_1$ and $B_2$ for storing data indicative of the statuses of the input select pushbuttons 9*a* and 9*b* and output select pushbuttons 11*a* and 11*b*, respectively, at the current sampling moment. The previous pushbutton status table 42 is likewise constituted of two input select pushbutton status regions $A_1'$ and $A_2'$ and two output select pushbutton status regions $B_1'$ and $B_2'$ for storing data indicative of the statuses of the input select pushbuttons 9*a* and 9*b* and output select pushbuttons 11*a* and 11*b*, respectively, at the previous sampling moment.

With reference back to FIG. 3 the signal path selector 3 according to the invention is a digital device composed principally of the DSP 16. This DSP is designed for execution of the program that is factory introduced into the ROM 14. The program includes a routine for checking the pushbuttons 9*a*, 9*b*, 11*a* and 11*b* one by one to see if they are depressed at each sampling moment, and another routine for copying the contents of the current pushbutton status table 41 to the previous pushbutton status table 42 prior to such checking. If any of the pushbuttons is found depressed as a result of their sequential checking, the digit "1" is written on the corresponding region or regions of the current pushbutton status table 41, and the digit "0" on the other regions of the table.

Following the checking of all the pushbuttons 9*a*, 9*b*, 11*a* and 11*b*, the current and previous pushbutton status tables 41 and 42 are compared to see any change in pushbutton status from one sampling moment to the next. A preexisting signal path or paths are maintained if no change is found. If a change is found with any pushbutton, on the other hand, then all the object names associated with this pushbutton are enumerated, and the following steps are taken:

1. To determine the direction in which the pushbutton has changed, that is, either from "off" to "on," or from "on" to "off."

2. To ascertain if either of the input select pushbuttons 9*a* and 9*b* and either of the output select pushbuttons 11*a* and 11*b* are depressed concurrently, and, if so, to create a signal path therebetween.

Figure 5:
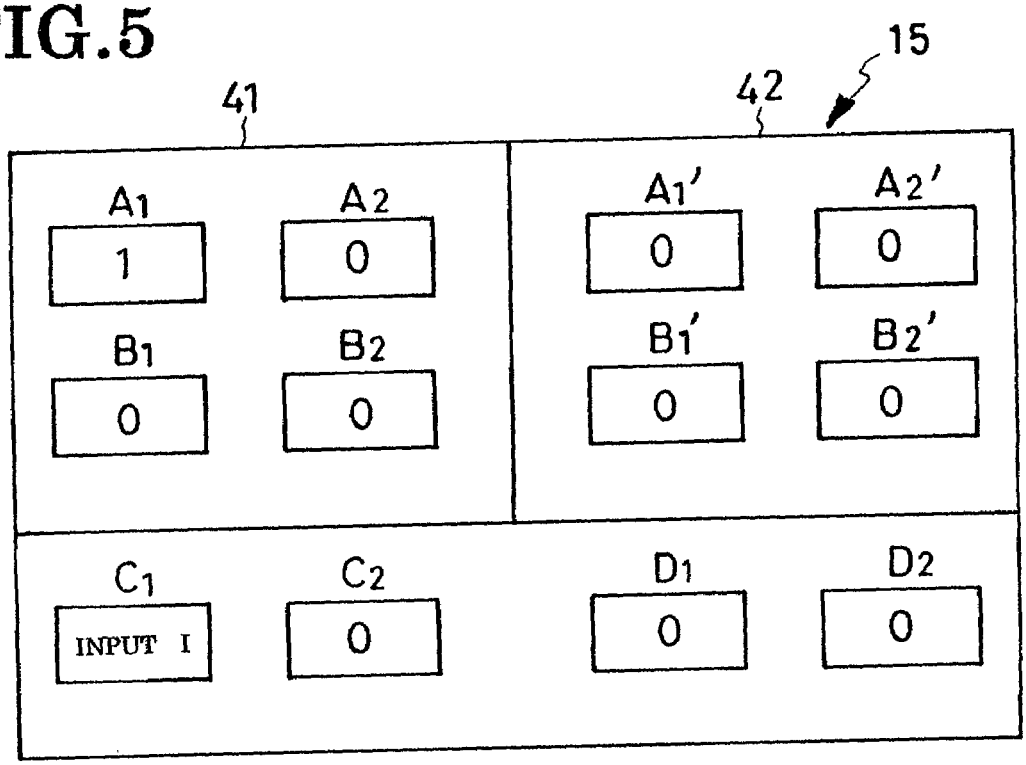
FIG. 5 is a diagram similar to FIG. 4 but showing the variables written RAM at one sampling moment in connecting one selected input terminal to one selected output terminal by the FIG. 3 signal path selector.
Figure 6:
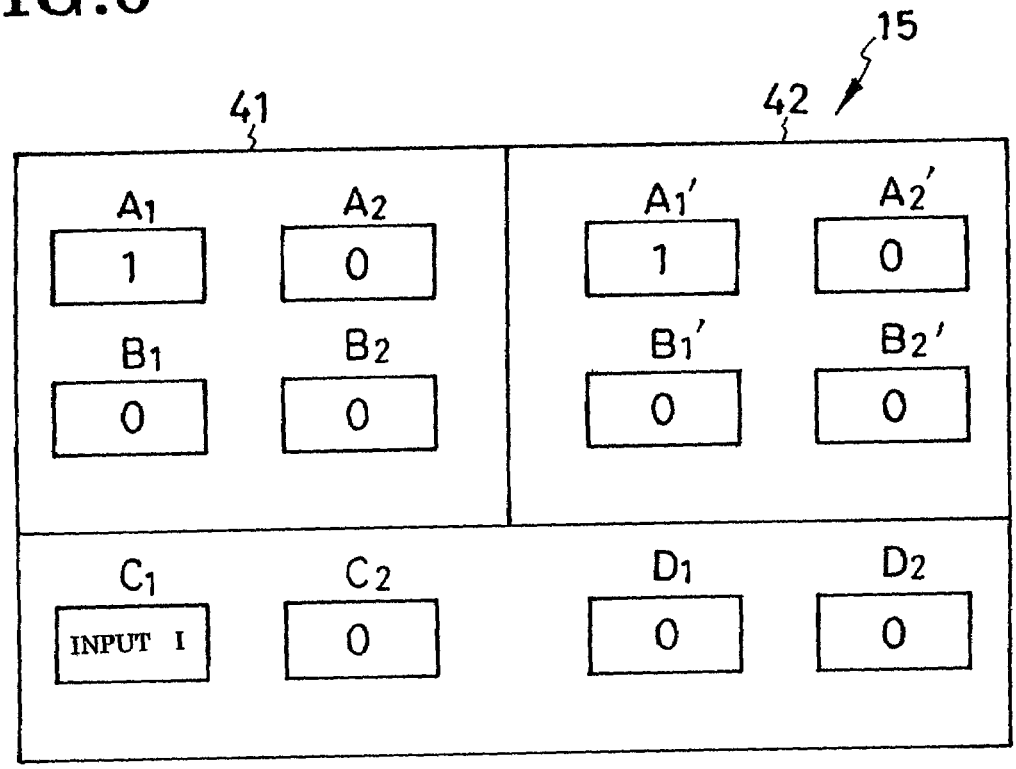
FIG. 6 is also a diagram similar to FIG. 4 but showing the variables written on the RAM at another sampling moment.
Figure 7:
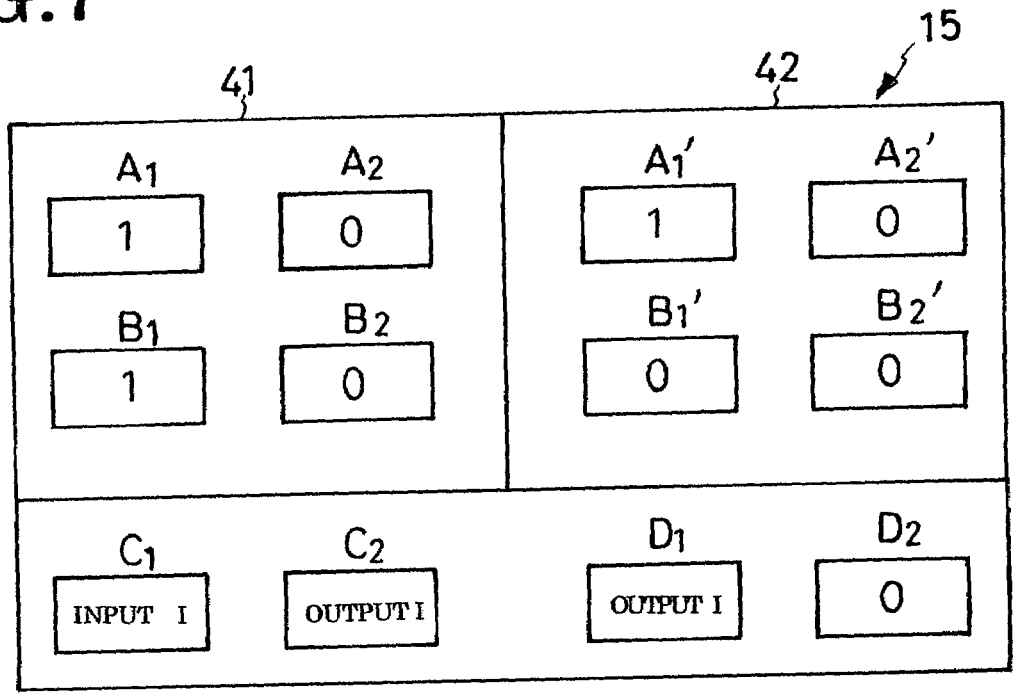
FIG. 7 is also a diagram similar to FIG. 4 but showing the variables written on the RAM at still another sampling moment.

Let us suppose that the operator wished to connect the first input terminal 6*a* to the first output terminal 7*a* and tried to press the first input select pushbutton 9*a* and first output select pushbutton 11*a* at the same time, but that, actually, he or she actuated the first input select pushbutton first and then both first input and first output select pushbuttons concurrently. FIGS. 5–7 are explanatory of what happens to the RAM 15 in the case assumed above.

FIG. 5 shows what happens to the RAM 15 in response to the actuation of the first input select pushbutton 9*a* at a certain sampling moment. The digit "1" is written at the first input select pushbutton status region $A_1$ of the current pushbutton status table 41. Further the object name "INPUT I," to which belongs the first input select pushbutton 9*a*, is stored at the input object name region $C_1$. Still further the first input select indicator 10*a* a will glow thereby visually indicating the operator choice of INPUT I.

In FIG. 6 is shown the status of the RAM 15 at the sampling moment following that of FIG. 5. This figure presupposes that no pushbuttons have been actuated since the moment of FIG. 5, so that the contents of the current pushbutton status table 41 in FIG. 5 are shown copied on the previous pushbutton status table 42 in FIG. 6. The tables 41 and 42 are therefore the same in contents.

At the next sampling moment, when both first input select pushbutton 9*a* and first output select pushbutton 11*a* are depressed concurrently, the RAM 15 will be in the state of FIG. 7. The digit "1" is shown stored at both first input select pushbutton status region $A_1$ and first output select pushbutton status region $B_1$, of the current pushbutton status table 41. Now a change has occurred between the first output select pushbutton status regions $B_1$, and $B_1'$ of the current pushbutton status table 41 and the previous pushbutton status table 42, so that the object name "OUTPUT I" is shown stored at the output object name region $C_2$. The first output select indicator 12*a* is lit up.

In FIG. 7, therefore, the object name "INPUT I" is shown stored at the input object name region $C_1$, and the object name "OUTPUT I" at the output object name region $C_2$. The next step is to refer this combination of objects to the table, not shown, on the ROM 14 listing all the effective combinations of the objects, in order to ascertain if the combination now under consideration is among them. No combination of two inputs, or two outputs, is effective, so that no further step is taken. No further step is taken, either, when three or more pushbuttons are actuated simultaneously. The combination in question, INPUT 1 and OUTPUT I, is effective. The object name "OUTPUT I" is therefore written at the first destination object region $D_1$, as in FIG. 7, as the desired object to which INPUT I is to be connected.

Possibly, any of the pushbutton switches may be opened when its object name is stored at the input object name region $C_1$ or the output object name region $C_2$. That object name is then erased. No response is made when any pushbutton switch is opened whose object name is stored at both input object name region $C_1$ and output object name region $C_2$.

How the two inputs and the two outputs are variously interconnected, and the interconnections cancelled, according to the invention will become better understood from a study of FIGS. 8–11. The top row in each of these figures, designated (A), represents the initial states of the input object name region $C_1$, output object name region $C_2$, first destination object region $D_1$ and second destination object region $D_2$, whereas the bottom row (B) represents their final states indicative of the connections established.

Figure 8:
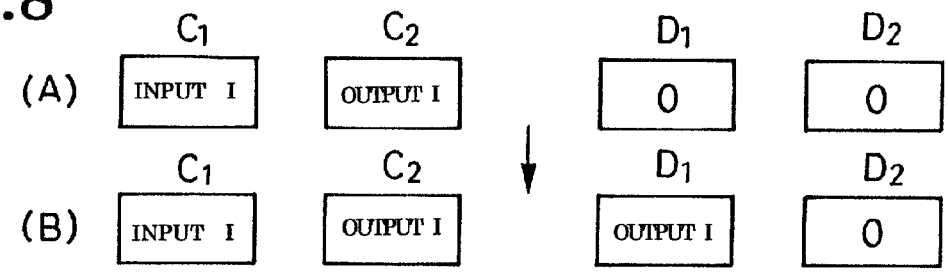
FIG. 8, consisting of (A) and (B), shows in block form some pertinent storage locations of the RAM in order to illustrate how a connection is made between one selected input terminal and one selected output terminal in the FIG. 3 signal path selector.

At (A) in FIG. 8 it is supposed that the operator has actuated both first input select pushbutton 9*a* and first output select pushbutton 11*a* to connect INPUT I to OUTPUT I, with the result that the object name "INPUT I" is stored at the input object name region $C_1$, and the object name "OUTPUT I" at the output object name region $C_2$. The DSP 16, FIG. 3, will then check the first destination object region $D_1$ to see if INPUT I is already connected to either of OUTPUT I and OUTPUT II. The digit "0" shown stored at the first destination object region $D_1$ at (A) in FIG. 8 indicates that the INPUT I is now connected to neither. Therefore, reading the object name "OUTPUT I" from the output-object name region $C_2$, the DSP 16 proceeds to confirm the effectiveness of OUTPUT I as a destination to which INPUT I is to be connected, and further to store that object name at the first destination object region $D_1$, as at (B) in FIG. 8. Now has been verified the connection of INPUT I and OUTPUT I.

This desired connection of INPUT I and OUTPUT I must be exclusive; that is, if INPUT II has already been connected to OUTPUT I, this preexisting connection must be excluded preparatory to the connection of INPUT I and OUTPUT I. The DSP 16 checks the second destination object region $D_2$ for establishment of such exclusive connection. The second destination object region $D_2$ is shown to be "0" at (A) in FIG. 8, meaning that INPUT II is not connected to OUTPUT I, so that it is shown remaining "0" at (B) in FIG. 8 too. If, contrary to the showing of FIG. 8, OUTPUT 1 were stored at the second destination object region $D_2$, the digit "1" would be erased, and "0" written in its stead. Further, if OUTPUT II were stored at the second destination object region $D_2$, meaning the preexistence of a connection between INPUT II and OUTPUT II, this connection would not interfere with the desired connection of INPUT I and OUTPUT I. The second destination object region $D_2$ would be left unchanged.

Figure 9:
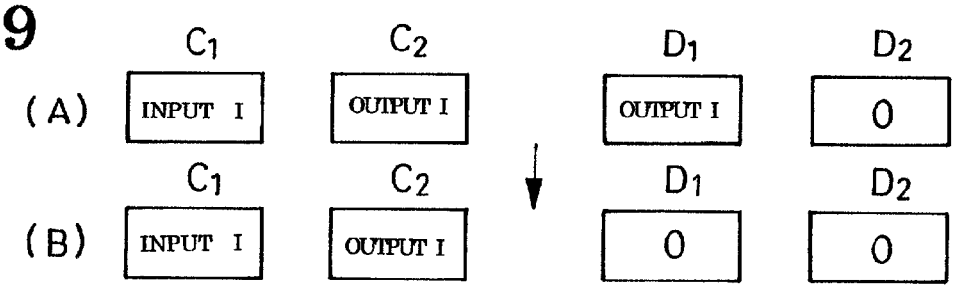
FIG. 9, consisting of (A) and (B), is a diagram similar to FIG. 8 but explanatory of how a preexisting connection is cancelled.

FIG. 9 is explanatory of how a preexisting connection is broken up. At (A) in this figure are shown the RAM regions $C_1$, $C_2$, $D_1$ and $D_2$ in the same states as at (B) in FIG. 8, indicating the preexisting connection between INPUT I and OUTPUT I. If now the first input select pushbutton 9*a* and first output select pushbutton 11*a* are operated simultaneously, OUTPUT I will be erased from the first destination objection region $D_1$, and the digit "0" written in its stead, as at (B) in FIG. 9. The digit "0" at the region $D_1$ means that INPUT I is connected to neither output. In short any preexisting connection is cancelled by actuation of the same pushbuttons as when that connection was made. It is believed that the operator will readily get used to this method of cancellation of preexisting connections.

Figure 10:
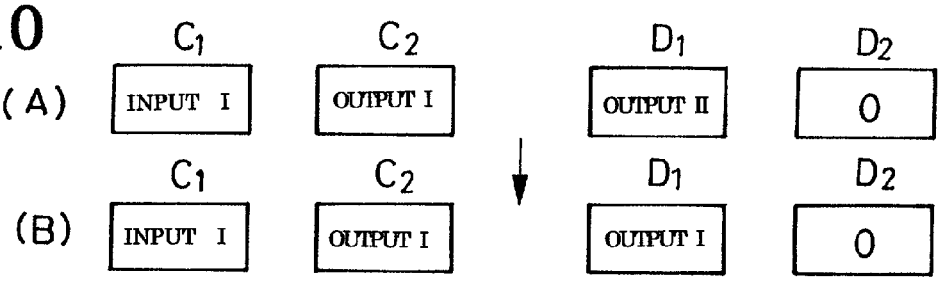
FIGS. 10 and 11, each consisting of (A) and (B), are also diagrams similar to FIG. 8 but explanatory of how a connection is made between one selected input terminal and one selected output terminal to the exclusion of a preexisting interfering connection.
Figure 11:
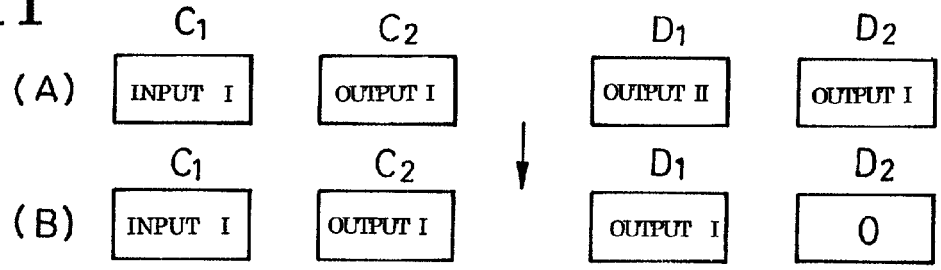

A consideration of FIGS. 10 and 11 will make clear how each new connection is established to the exclusion of any preexisting interfering connection. FIG. 10 shows at (A) that a connection preexists between INPUT I and OUTPUT II, as indicated by the object name "OUTPUT II" stored at the first destination object region $D_1$. If now the first input select pushbutton 9*a* and the first output select pushbutton 11*a* are depressed simultaneously, the object name "INPUT I" will be stored at the input object name region $C_1$, and "OUTPUT I" at the output object name region $C_2$, as at (B) in FIG. 10. At the same time, as indicated also at (B) in FIG. 10, the object name "OUTPUT I" will be overwritten on the preexisting object name "OUTPUT II" at the first destination object region $D_1$ as the object to which INPUT I is to be connected.

Then the second destination object region $D_2$ is checked to see if OUTPUT I is stored there. The digit "0" shown at $D_2$ in FIG. 10 indicates that OUTPUT I is not stored there, meaning that no interfering connection preexists between INPUT II and OUTPUT I. However, if OUTPUT I is stored at $D_2$ as at (A) in FIG. 11, there is a preexisting interfering connection between INPUT II and OUTPUT I. Then this preexisting connection is eliminated by writing "0" at $D_2$, as at (B) in FIG. 11, for creation of the desired new connection between INPUT I and OUTPUT 1.

The DSP 16 of the signal path selector 3 is preprogrammed to comply with the indications of the destination object regions $D_1$ and $D_2$ of the RAM 15 for connecting each of INPUT I and INPUT II to either of OUTPUT I and OUTPUT II.

Furthermore, in step with such manipulation of the pushbuttons, the DSP 16 causes the input select indicators 10*a* and 10*b* and output select indicators 12*a* and 12*b* to glow as visual aids to the creation of desired connections, as will be apparent from a consideration of FIG. 3. These indicators are to glow as dictated by the object names written at the input object name region $C_1$ and output object name region $C_2$. In the case shown at (A) in FIG. 8, for instance, the first input select indicator 10*a* and first output select indicator 12*a* are to glow inconformity with INPUT I stored at the input object name region $C_1$ and OUTPUT I stored at the output object name region $C_2$. The indicators 10*a*, 10*b*, 12*a* and 12*b* may glow either only while the associated pushbuttons are being depressed, or until alternative pushbuttons are actuated. As desired, moreover, those indicators may be made to blink which correspond to the objects between which connections have been established.

Figure 12:
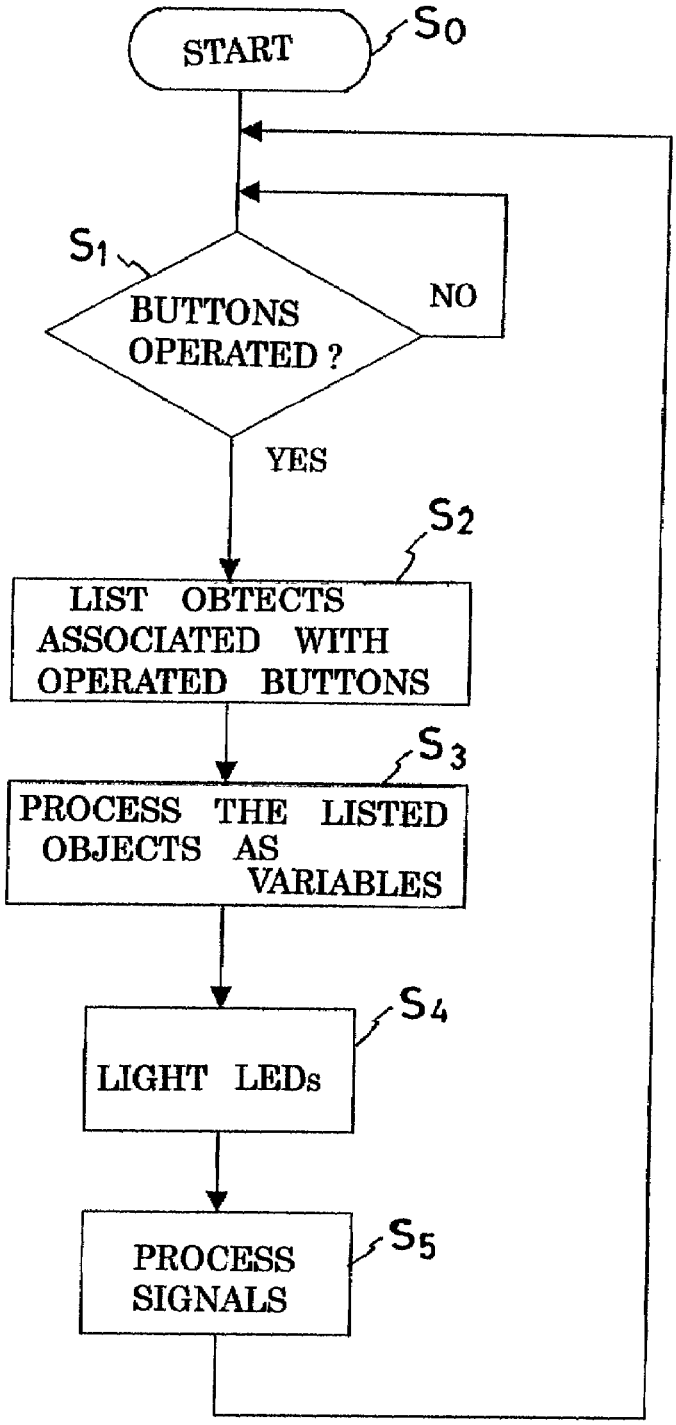
FIG. 12 is a flowchart of the connection control program introduced into the FIG. 3 signal path selector.

The reader's attention is now invited to the flowchart of FIG. 12 for a study of the connection control program of the signal path selector 3. The main connection control program is designed in support of the above discussed method of providing connections between input terminals 6*a* and 6*b* and output terminals 7*a* and 7*b*. The RAM 15 and DSP 16, FIG. 3, are both initialized as the program is invoked at $S_0$. Initially, no signal path exists between input terminals 6*a* and 5*b* and output terminals 7*a* and 7*b*. It is understood that the pushbutton switches 21–24 are scanned periodically to determine whether they are open or closed. Either the sampling pulses used for data transfer, or those from a dedicated source of such pulses, may be utilized for the periodic scanning of the pushbutton switches.

It is asked at the node $S_1$ of the connection control program whether a change has occurred to each of the pushbutton switches 21–24. This question is answerable by comparison of the current pushbutton status table 41, FIG. 4, and the previous pushbutton status table 42. As has been stated, these tables 41 and 42 indicate the statuses of the input and output select pushbutton switches 21–24 at the current and preceding sampling moments, respectively. If a change is found in any one or more of the pushbutton switches, the associated object name or names are written at the variables region or regions of the RAM 15. The object name or names are first temporarily listed on the RAM 15 according to the block $S_2$.

Then, as dictated by the next block $S_3$, the listed object name or names are processed as variables for storage at the input select pushbutton status regions $A_1$ and $A_2$ and output select pushbutton status regions $B_1$ and $B_2$ of the current pushbutton status table 41, the input select pushbutton status regions $A_1'$ and $A_2'$ and output select pushbutton status regions $B_1'$ and $B_2'$ of the previous pushbutton status table 42, the input object name region $C_1$, the output object name region $C_2$, the first destination object region $D_1$, and the second destination object region $D_2$ of the RAM 15. More will be said presently about such variables with reference to FIGS. 13A–13C. The variables now under consideration are stored on the destination object regions $D_1$ and $D_2$ as in FIGS. 8–11. The object names temporarily listed as above on the RAM 15 are erased upon storage of the variables on the regions $D_1$ and $D_2$.

Now that the desired connections between input terminals 6*a* and 6*b* and output terminals 7*a* and 7*b* have been confirmed, any required ones of the indicators 10*a*, 10*b*, 12*a* an 12*b* are lit up according to the block $S_4$.

Then comes the final block $S_5$ which dictates signal transfer. If now the first input terminal 6*a* and the first output terminal 7*a* are interconnected, the analog audio signal incoming through the first input terminal 6*a* will be digitized by the ADC 13, then directed into the DAC 17 thereby to be reconverted into analog format, and then put out from the first output terminal 7*a*.

Figure 13A:
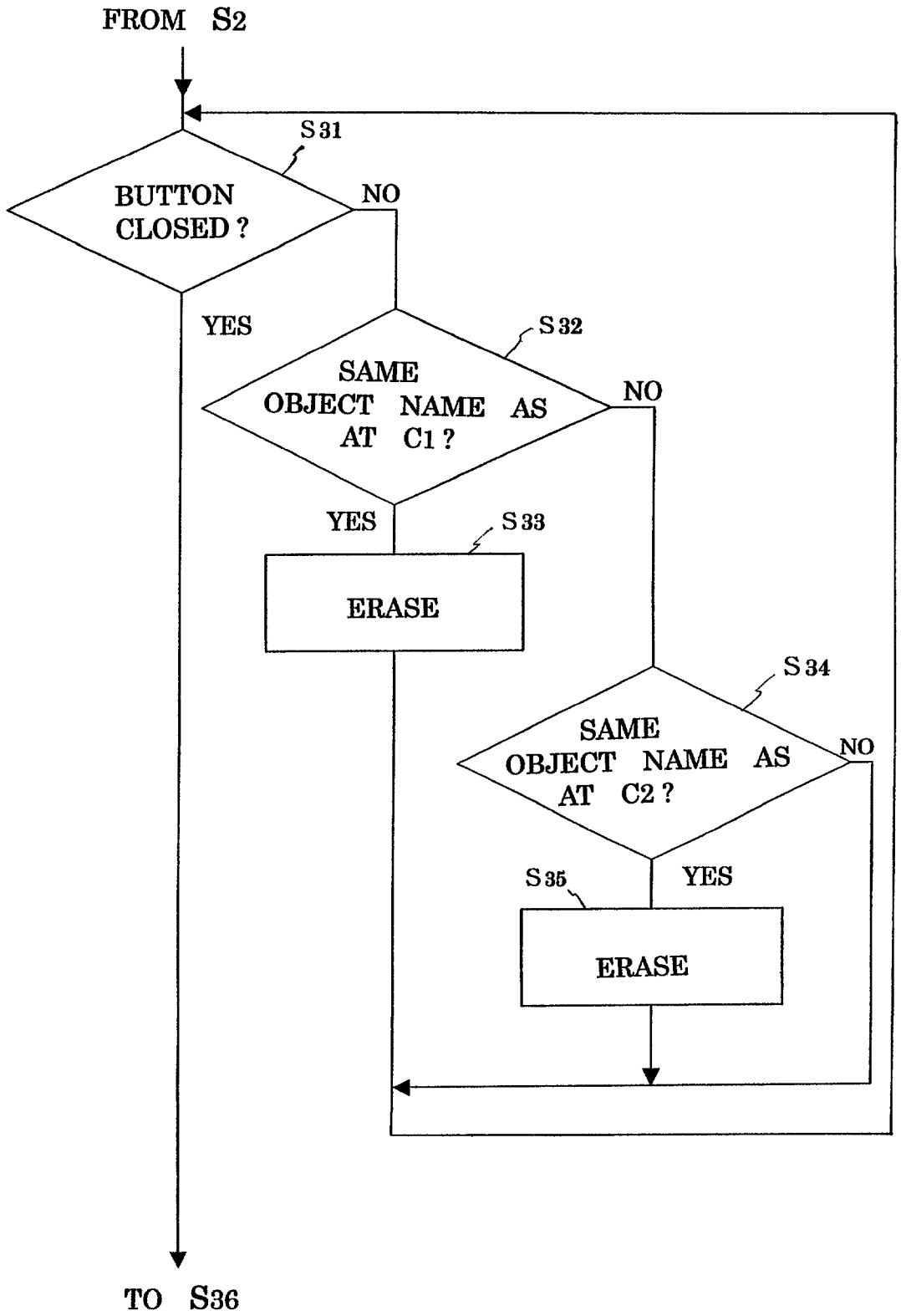
FIGS. 13A, 13B and 13C constitute in combination a flowchart of a subroutine of the FIG. 12 connection control program.
Figure 13B:
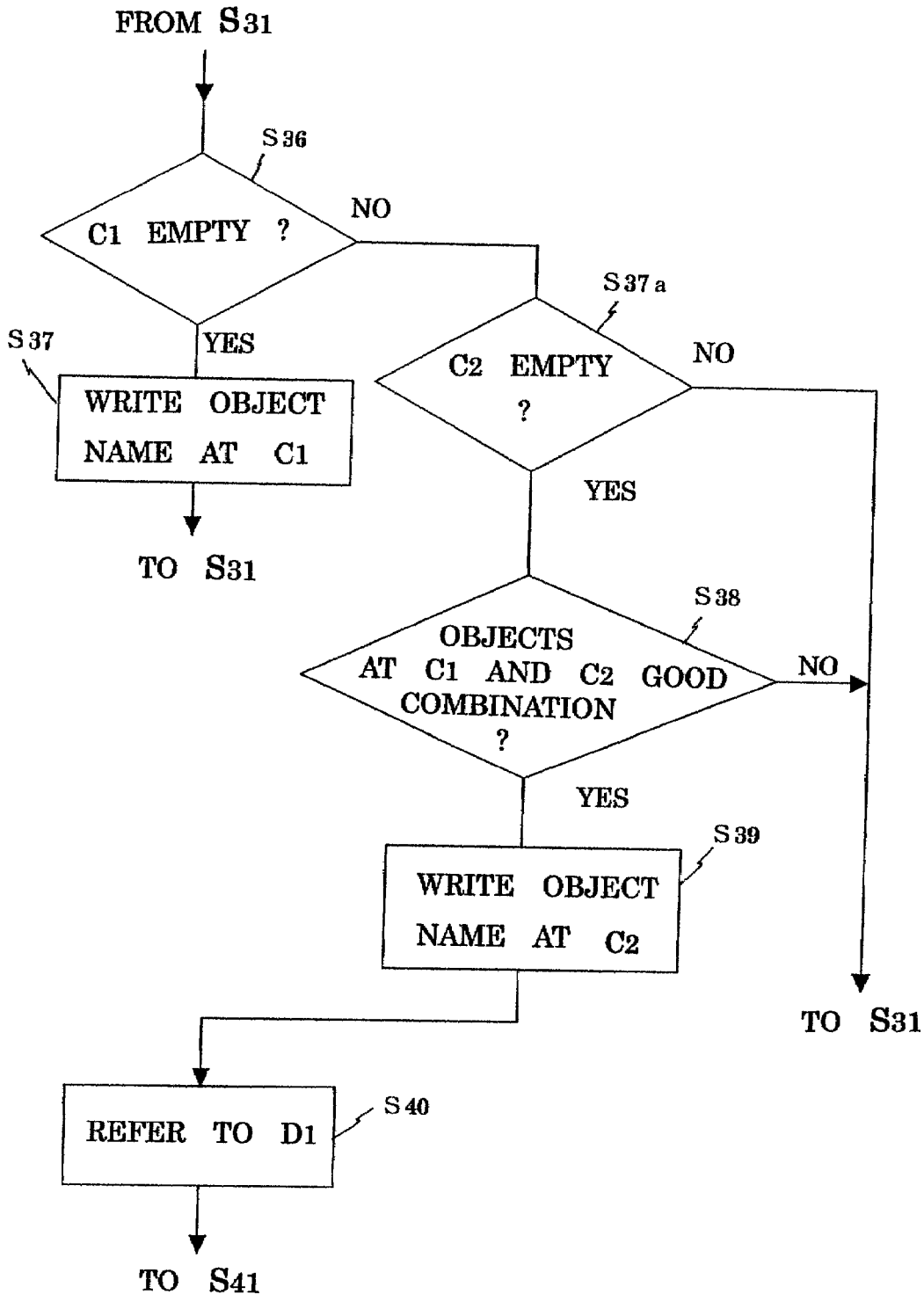
Figure 13C:
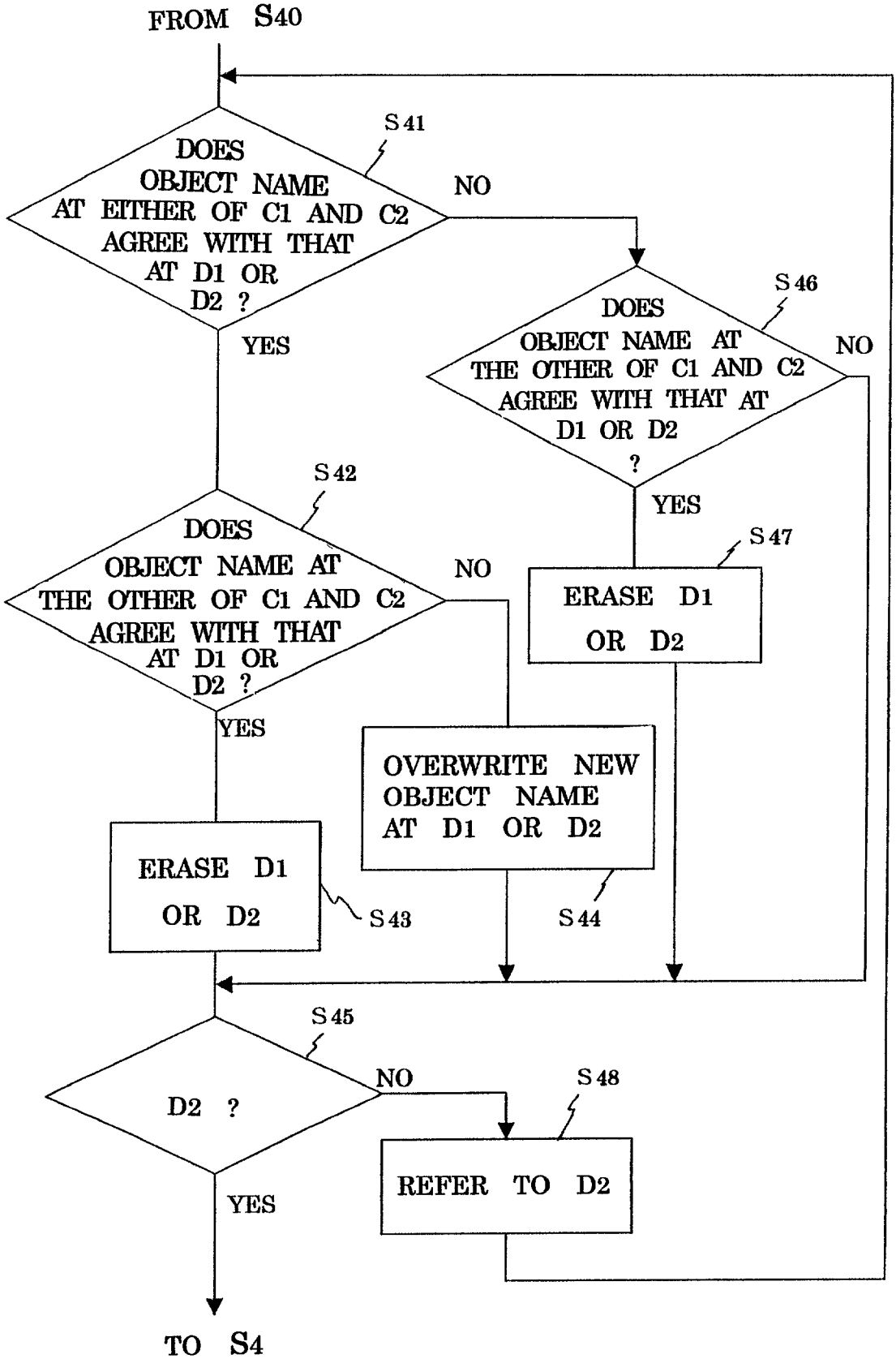

FIGS. 13A–13C show in combination the subroutine to be executed at the block $S_3$ of the FIG. 12 connection control program. The subroutine starts with the node $S_{31}$, FIG. 13A, which asks whether any pushbutton switch that has been found to have changed in state at the node $S_1$, FIG. 12, is now closed. If the answer is "no," that is, if the switch is now open, it means that the pushbutton has been actuated out of engagement with the fixed contacts of that switch. In this case only the input object name region $C_1$ and output object name region $C_2$ are rewritten as required. The answer "no" to the node $S_{31}$ leads therefore to another node $S_{32}$, which asks if the input object name region $C_1$ stores the name of the object to which belongs the pushbutton switch that is now assumed to have been opened. If it does, that object name is erased from the input object name region $C_1$ at the block $S_{33}$. Then the subroutine returns to the node $S_{31}$.

If the answer to the node $S_{32}$ is "no," on the other hand, then it is ascertained at the block $S_{34}$ if the output object name region $C_2$ stores the name of the object to which belongs the pushbutton switch that is assumed to have been opened as above. If the answer to this question is "yes," the currently stored object name is erased at the next step $S_{35}$, from which the subroutine returns to the node $S_3$. If the answer is "no," on the other hand, then presumably the pushbutton switch that has been opened was indicative of a wrong connection. In this case, therefore, the subroutine returns from node $S_{34}$ directly to node $S_{31}$.

The answer to the node $S_3$, may be "yes," that is, the pushbutton switch in question may now be closed, with the pushbutton pressed down. Then it is ascertained at the next node $S_{36}$, FIG. 13B, if the input object name region $C_1$ is empty, or has the digit "0" written thereon. If it is, no pushbutton was depressed at the preceding sampling moment. The desired input object name at the current sampling moment is therefore written at the input object name region $C_1$ according to the block $S_{37}$. The subroutine returns from this block $S_{37}$ to the node $S_{31}$.

If the answer to the node $S_{36}$ is "no," on the other hand, that is, if some object name has been written at the input object name region $C_1$, then it is ascertained at the next node $S_{37a}$ if the output object name region $C_2$ is empty. If it is not, a wrong manipulation was presumably made, so that the subroutine returns from the node $S_{37a}$ to the node $S_{31}$. If the output object name region $C_2$ is empty, on the other hand, then it is determined at the next node $S_{38}$ whether the object name that has been stored at the input object name region $C_1$ makes a good combination with the object that has been just specified by depression of the associated pushbutton. The answer will be "no" if they are a bad combination of two input objects or of two output objects, with the result that the subroutine returns to the node $S_{31}$. If they are a good combination, on the other hand, then the object name just specified is written at the output object name region $C_2$ according to the block $S_{39}$.

Now the subroutine proceeds to deal with the two destination object regions $D_1$ and $D_2$. First, according to the block $S_{40}$, the first destination object region $D_1$ is referred to, and the object name "INPUT I" is read out therefrom. Then, according to the following node $S_{41}$, FIG. 13C, it is ascertained if the object name stored at either of the input object name region $C_1$ and output object name region $C_2$ agrees with the object name stored at whichever of the destination object regions $D_1$ and $D_2$ now being referred to. For instance, it is ascertained if the input object name region $C_1$ now stores the object name "INPUT I" which is to be connected to the object whose name is stored at the destination object region $D_1$, as at (A) in all of FIGS. 8–11.

If the answer to the node $S_{41}$ is "no," it is subsequently determined according to the node $S_{46}$ if the object name stored at the other of the input object name region $C_1$ and output object name region $C_2$ agrees with the object name stored at whichever of the destination object regions $D_1$ and $D_2$ now being referred to. The answer to the node $S_{46}$ will be "yes" if, for instance the object name "OUTPUT I" is stored at both the output object name region $C_2$ and the second destination object region $D_2$ as at (A) in FIG. 11. Then the object name stored at the second destination object region $D_2$ is erased according to the block $S_{47}$. The digit "0" is written there instead, as at (B) in FIG. 11, thereby canceling the current connection. The subroutine returns from the block $S_{46}$ directly to the block $S_{45}$ if the answer to the former is "no."

If the answer to the node $S_{41}$ is "yes," on the other hand, then the next node $S_{42}$ asks if the object name stored at the other of the input object name region $C_1$ and output object name region $C_2$ agrees with that stored at whichever of the destination object regions $D_1$ and $D_2$ now being referred to. The answer to the node $S_{42}$ will be "no" if, as indicated at (A) in FIG. 10 by way of example, the object names disagree between $C_2$ and $D_1$. Then, according to the block $S_{44}$, the desired new output object name (e.g., OUTPUT I) is overwritten at whichever of the destination object regions $D_1$ and $D_2$ now being referred to, as indicated at (B) in FIG. 10. The answer to the node $S_{42}$ will be "yes" if the same object name is stored at both $C_2$ and $D_1$ as at (A) in FIG. 9. Then the object name is erased from whichever of the destination object regions $D_1$ and $D_2$ now being referred to, according to the block $S_{43}$, thereby nullifying the current connection.

The subroutine proceeds from all of the blocks $S_{43}$, $S_{44}$ and $S_{47}$ as well as the "no" output of the node $S_{46}$ to the node $S_{45}$, which asks whether the last destination object region $D_2$ is being referred to. If it is not, then the object name of the destination object region $D_2$ is checked according to the next block $S_{48}$, from which the subroutine returns to the node $S_{41}$. If the answer to the node $S_{45}$ is "yes," on the other hand, the subroutine returns to the block $S_4$, FIG. 12, of the connection control program.

The advantages gained by this particular embodiment of the invention may be recapitulated as follows:

1. Any possible connections between input terminals 6*a* and 6*b* an output terminals 7*a* and 7*b* can be formed by simple depression of the input select pushbuttons 9*a* and 9*b* and output select pushbuttons 11*a* and 11*b*, without the risk of concurrently connecting either one input to two outputs.

2. One-to-one connection between inputs and outputs is assured as desired new object names are overwritten on preexisting ones.

3. The input select indicators 10*a* and 10*b* and output select indicators 12*a* and 12*b*, all preferably in the form of LEDs, are provided in close proximities of the input select pushbuttons 9*a* and 9*b* and output select pushbuttons 11*a* and 11*b*, respectively, enabling the operator to visually confirm the connections he has made.

4. The first input terminal 6*a*, first input select pushbutton 9*a* and first input select indicator 10*a*, all belonging to the object named "INPUT I", are positioned close to one another, and so are the second input terminal 6*b*, second input select pushbutton 9*b* and second input select indicator 10*b* of the object "INPUT II." Similarly, the first output terminal 7*a*, first output select pushbutton 11*a* and first output select indicator 12*a* of the object "OUTPUT I" are positioned close to one another, and so are the second output terminal 7*b*, second output select pushbutton 11*b* and second output select indicator 12*b* of the object "OUTPUT II." The operator is therefore enabled to know exactly what he or she is doing, just as he or she does when handling patch cables on a patch bay.

Alternate Embodiment

The fundamental constructional and operational features of the instant invention are believed to be apparent from the foregoing embodiment of the instant invention. Shown in FIG. 14, then, is the digital mixer that is representative of an actual device in which the invention may be embodied in practice. Generally designated 3*a*, the digital mixer is shown to have four analog input terminals 6*a*–6*d* as a first group of objects, and four mixing modules 50*a*–50*d* as a second group of objects. The two groups of objects are to be selectively connected to one another according to the invention. The four input terminals 6*a*–6*d* are all connected via the ADC 13 to the bus 18, to which bus are also connected the mixing modules 50*a*–50*d*.

Figure 14:
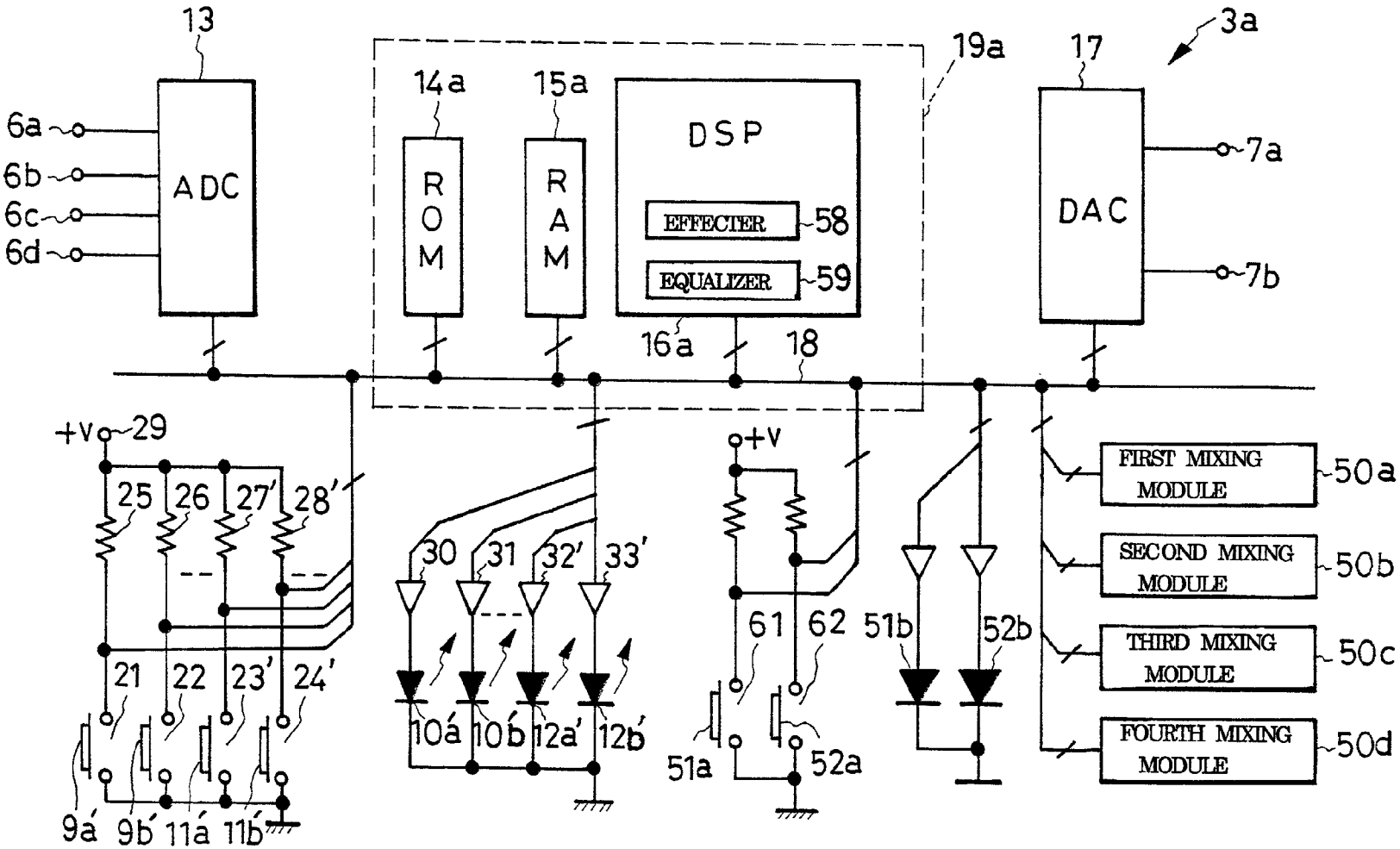
FIG. 14 is a view similar to FIG. 3 but showing the invention as applied to a digital mixer.
Figure 15:
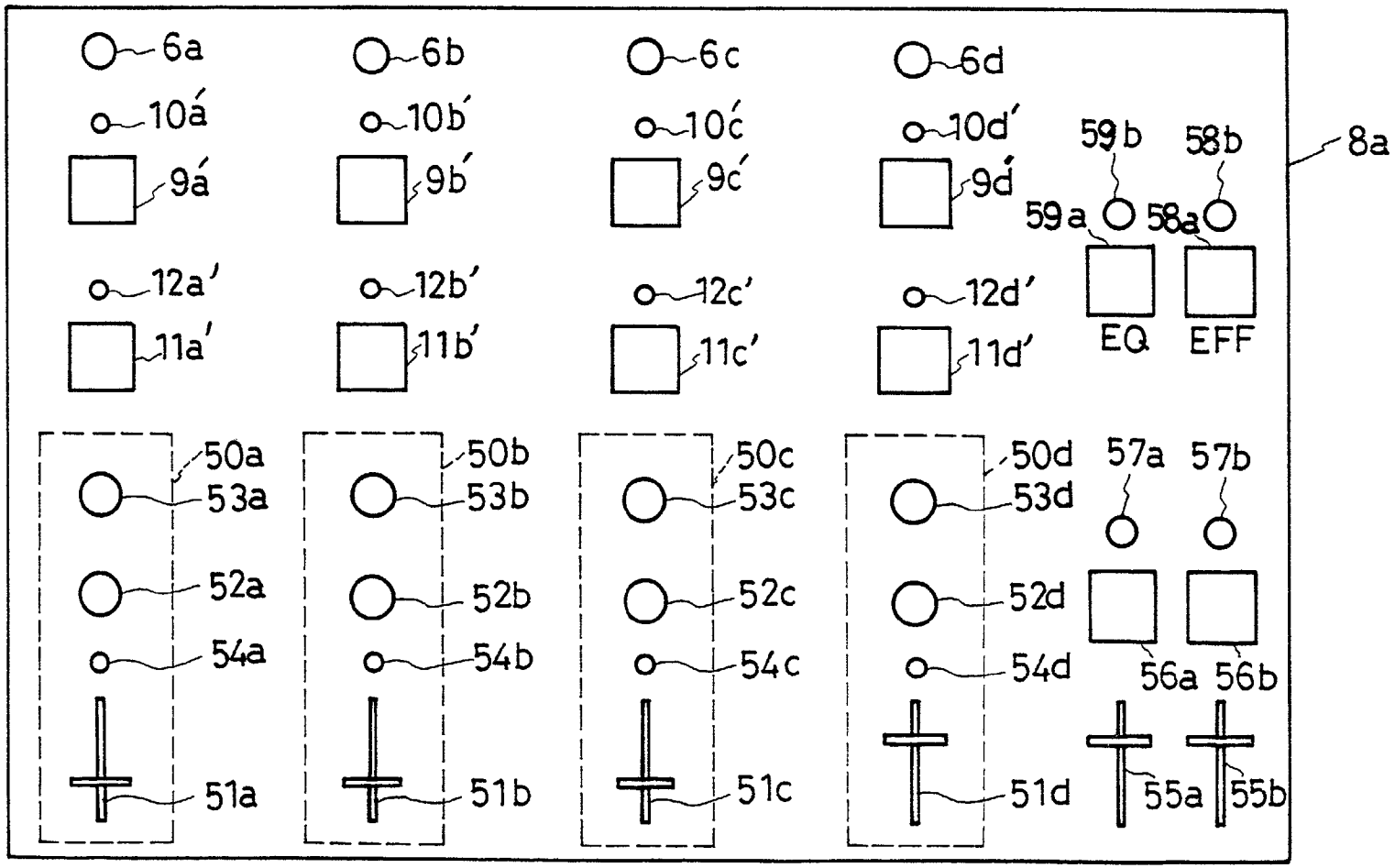
FIG. 15 is a view similar to FIG. 2 but showing the control panel of the FIG. 14 digital mixer.

As illustrated in FIG. 15, which shows the control panel 8*a* of the FIG. 14 mixer 3*a*, the four input terminals 6*a*–6*d* are arranged in a row on the control panel. Under these input terminals 6*a*–6*d*, four input select pushbuttons 9*a*'–9*d*' and four input select indicators 10*a*'–10*d*' are disposed adjacent the respective input terminals 6*a*–6*d*. The pushbuttons 9*a*'–9*d*' and indicators 10*a*'–10*d*' perform the same functions as the pushbuttons 9*a* and 9*b* and indicators 10*a* and 10*b*, FIG. 2, of the previous embodiment.

As indicated also in FIG. 15, the mixing modules 50*a*–50*b* are represented on the control panel 8*a* as having fader controls 51*a*–51*d*, panpots 52*a*–52*d*, gain controls 53*a*–53*d*, and equalizer indicators 54*a*–54*d*, respectively. All these mixing module components, shown enclosed in the broken-line rectangles and generally labeled 50*a*–50*d* for convenience, are disposed under the four input terminals 6*a*–6*d*, respectively.

For selective connection of the input terminals 6*a*–6*d* to the mixing modules 50*a*–50*d*, there are provided four mixing module select pushbuttons 11*a*'–11*d*', complete with four mixing module select indicators 12*a*'–12*d*', each between one input terminal and one associated mixing module. The mixing module select pushbuttons 11*a*'–11*d*' are similar in function to the output select pushbuttons 11*a* and 11*b*, FIG. 2, of the previous embodiment, and so are the mixing module select indicators 12*a*'–12*d*' to the output select indicators 12*a* and 12*b* of the previous embodiment.

Despite the showing of FIG. 15, however, FIG. 14 shows only the first two input select pushbuttons 9*a*' and 9*b*' with their switches 21 and 22, the first two input select indicators 10*a*' and 10*b*', the first two mixing module select pushbuttons 11*a*' and 11*b*' with their switches 23' an 24', and the first two mixing module select indicators 12*a*' and 12*b*'. The other two input select pushbuttons 9*c*' and 9*d*' and the other two mixing module select pushbuttons 11*c*' and 11*d*', which are shown in FIG. 15, are not in FIG. 14 for lack of space.

Also shown arranged on the FIG. 15 control panel 8*a* are two master fader controls 55*a* an 55*b*, two maser fader select pushbuttons 56*a* and 56*b*, two master fader select indicators

57*a* and 57*b*, an effecter select pushbutton 58*a*, an effecter select indicator 58*b*, an equalizer select pushbutton 59*a*, and an equalizer select pushbutton 59*b*. The two output terminals 7*a* and 7*b* together with their select pushbuttons and indicators are also provided on the control panel 8*a* but now shown in FIG. 15 for lack of space.

The effecter 58 and equalizer 59 shown included in the DSP 16*a*, FIG. 14, for convenience can both serve only one channel at one time, so that the four input terminals 6*a*–6*d* are to be selectively connected thereto for use. The effecter 58 and equalizer 59 may be thought of as each having an input and an output for selective connection respectively to the four input terminals 6*a*–6*d* and to the four mixing modules 50*a*–50*d*. When these effecter and equalizer are to be so inserted, their input terminals form the output-side objects to which are to be selectively connected the input terminals 6*a*–6*d*, and their output terminals for the input-side objects to be selectively connected to the mixing modules 50*a*–50*d*.

How such input- and output-side objects of this digital mixer 3*a* are selectively interconnected is considered self-evident from the foregoing description of the FIGS. 1–3 embodiment, with reference had to FIGS. 4–13. The ROM 14*a*, RAM 15*a* and DSP 16*a* of the FIG. 14 digital mixer 3*a* are shown enclosed in the dashed outline as constituting the control means 19*a* for effecting such selective connection. No further operational description of the digital mixer 3*a* will therefore be necessary except for the following definitions of the objects for use in selective connection of mixer input terminals 6*a*–6*d* and mixing modules 50*a*–50*d*:

Input-side object "INPUT I":
First input terminal 6*a*, first input select pushbutton 9*a*', and first input select indicator 10*a*'.

Input-side object "INPUT II":
Second input terminal 6*b*, second input select pushbutton 9*b*', and second input select indicator 10*b*'.

Input-side object "INPUT III":
Third input terminal 6*c*, third input select pushbutton 9*c*', and third input select indicator 10*c*'.

Input-side object "INPUT IV":
Fourth input terminal 6*d*, fourth input select pushbutton 9*d*', and fourth input select indicator 10*d*'.

Output-side object "OUTPUT I":
First mixing module 50*a*, first mixing module select pushbutton 11*a*', and first mixing module select indicator 12*a*'.

Output-side object "OUTPUT II":
Second mixing module 50*b*, second mixing module select pushbutton 11*b*', and second mixing module select indicator 12*b*'.

Output-side object "OUTPUT III":
Third mixing module 50*c*, third mixing module select pushbutton 11*c*', and third mixing module select indicator 12*c*'.

Output-side object "OUTPUT IV":
Fourth mixing module 50*d*, fourth mixing module select pushbutton 11*d*', and fourth mixing module select indicator 12*d*'.

It will also be appreciated that all these input-side objects, INPUT I, INPUT II, INPUT III and INPUT IV, and output-side objects, OUTPUT I, OUTPUT II, OUTPUT III and OUTPUT IV, are selectively connected to each other to the exclusion of any preexisting interfering connection or connections therebetween. The same holds true with selective connection between the input terminals 6*a*–6*c* and the effecter 58 and equalizer 59 and between these effecter and equalizer and the mixing modules 50*a*–50*d*.

Although the present invention has been shown and described hereinbefore in specific aspects thereof, first in its simplest, rather conceptual form and then in more practical form, it is not desired that the invention be limited by the exact details of such disclosure. A variety of modifications or alterations may be adopted in the practice of this invention in order to conform to design preferences or to the requirements of each specific application. For instance, the concepts of the invention may be applied to selective connection between the master faders 55*a* and 55*b*, FIG. 15, and output terminals 7*a* and 7*b*, FIG. 14, of the digital mixer 3*a*. It is therefore appropriate that the invention be construed broadly and in a manner consistent with the fair meaning or proper scope of the subjoined claims.

What is claimed is:

1. A method of selectively providing a desired electric signal path or paths between a plurality of input means such as input terminals and a plurality of output means such as output terminals, which method comprises:

(a) providing input select means and output select means capable of manual actuation for selecting any of a plurality of input means and any of a plurality of output means for creation of a signal path therebetween;

(b) constantly monitoring the input select means and the output select means to determine whether any of the input means and any of the output means are selected for creation of a signal path therebetween;

(c) storing data indicative of whether or not the individual input means and the individual output means are selected at a current sampling moment;

(d) storing data indicative of whether or not the individual input means and the individual output means were selected at a previous sampling moment;

(e) comparing, at each sampling moment, the data stored at the current and the previous sampling moments in order to determine whether any of the input means and any of the output means are selected for creation of a signal path therebetween;

(f) canceling, when any one input means and any one output means are selected for creation of a signal path therebetween, a preexisting signal path, if any, between the selected input means and any unselected output means and between any unselected input means and the selected output means; and (g) creating the desired signal path between the selected input means and the selected output means;

(h) whereby each desired signal path can be created to the exclusion of any preexisting signal path between the input means and the output means that might interfere with the creation of the desired signal path.

2. The method of claim 1 wherein the desired signal path is created when the associated input select means and output select means are actuated concurrently.

3. A method of selectively providing a desired electric signal path or paths between a plurality of input means such as input terminals and a plurality of output means such as output terminals, which method comprises:

(a) laying out all the input means and all the output means on a control panel in prescribed arrangement;

(b) positioning on the control panel a plurality of input select pushbutton switches one adjacent each input means, and a plurality of output select pushbutton switches one adjacent each output means, the input select pushbutton switches and the output select pushbutton switches being positioned so close to one another that any one input select pushbutton switch and any one output select pushbutton switch are capable of concurrent one-hand, finger-pressure actuation to select one associated input means and one associated output means for creation of a signal path therebetween;

(c) constantly monitoring all the input select pushbutton switches and all the output select pushbutton switches to determine whether any of the input select pushbutton switches and any of the output select pushbutton switches are concurrently actuated;

(d) storing data indicative of whether or not the individual input select pushbutton switches and the individual output select pushbutton switches are selected at a current sampling moment;

(e) storing data indicative of whether or not the individual input select pushbutton switches and the individual output select pushbutton switches were selected at a previous sampling moment;

(f) comparing, at each sampling moment, the data stored at the current and the previous sampling moments in order to determine whether any of the input means and any of the output means are selected for creation of a signal path therebetween;

(g) canceling, when any one input means and any one output means are selected for creation of a signal path therebetween, a preexisting signal path, if any, between the selected input means and any unselected output means and between any unselected input means and the selected output means; and (h) creating the desired signal path between the selected input means and the selected output means;

(i) whereby each desired signal path can be created to the exclusion of any preexisting signal path between the input means and the output means that might interfere with the creation of the desired signal path.

4. The method of claim 3 which further comprises:

(a) positioning on the control panel a plurality of input select indicators one adjacent each output means, and a plurality of output select indicators one adjacent each output mean; and (b) causing one associated input select indicator and one associated output select indicator to glow upon concurrent finger-pressure actuation of one input select pushbutton switch and one output select pushbutton switch.

5. A signal path selector for selectively providing a desired electric signal path or paths between a plurality of input means such as input terminals and a plurality of output means such as output terminals, comprising:

(a) a plurality of input means;

(b) a plurality of output means;

(c) input select means capable of manual actuation for selecting any of the input means for creation of a signal path to any selected output means;

(d) output select means capable of manual actuation for selecting any of the output means for creation of a signal path from any selected input means;

(e) control means responsive to the actuation of the input select means and the output select means for creating the desired signal path between any selected input means and any selected output means to the exclusion of any preexisting signal path between the input means and the output means that might interfere with the creation of the desired signal path, the control means comprising:

(1) means for storing data indicative of whether or not the individual input means and the individual output means are selected by the input select means and the output select means at a current sampling moment;

(2) means for storing data indicative of whether or not the individual input means and the individual output means were selected by the input select means and the output select means at a previous sampling moment; and (3) means for comparing, at each sampling moment, the data stored at the current and the previous sampling moments in order to determine whether any of the input means and any of the output means are selected for creation of a signal path therebetween.

6. The signal path selector of claim 5 further comprising indicator means for visually indicating which of the input means and which of the output means are selected by the input select means and the output select means for creation of a signal path therebetween.

7. A signal path selector for selectively providing a desired electric signal path or paths between a plurality of input means such as input terminals and a plurality of output means such as output terminals, comprising:

(a) a control panel;

(b) a plurality of input means and a plurality of output means laid out on the control panel in prescribed arrangement;

(c) a plurality of input select pushbutton switches positioned on the control panel one adjacent each input means;

(d) a plurality of output select pushbutton switches positioned on the control panel one adjacent each output means, the input select pushbutton switches and the output select pushbutton switches being positioned so close to one another that any one input select pushbutton switch and any one output select pushbutton switch are capable of concurrent one-hand, finger-pressure actuation to select one associated input means and one associated output means for creation of a signal path therebetween; and (e) control means responsive to the actuation of the input select pushbutton switches and the output select pushbutton switches for creating the desired signal path between any selected input means and any selected output means to the exclusion of any preexisting signal path between the input means and the output means that might interfere with the creation of the desired signal path, the control means comprising:

(1) means for storing data indicative of whether or not the individual input means and the individual output means are selected by the input select pushbutton switches and the output select pushbutton switches at a current sampling moment;

(2) means for storing data indicative of whether or not the individual input means and the individual output means were selected by the input select pushbutton switches and the output select pushbutton switches at a previous sampling moment; and (3) means for comparing, at each sampling moment, the data stored at the current and the previous sampling moments in order to determine whether any of the input means and any of the output means are selected for creation of a signal path therebetween.

8. A signal path selector for selectively providing a desired electric signal path or paths between a plurality of input means such as input terminals and a plurality of output means such as output terminals, comprising:

(a) a control panel;

(b) a plurality of input means and a plurality of output means laid out on the control panel in prescribed arrangement;

(c) a plurality of input select means positioned on the control panel one adjacent each input means;

(d) a plurality of output select means positioned on the control panel one adjacent each output means, the input select means and the output select means being positioned so close to one another that any one input select means and any one output select means are capable of concurrent one-hand, finger-pressure actuation to select one associated input means and one associated output means for creation of a signal path therebetween;

(e) a plurality of input select indicators positioned on the control panel one adjacent each input means;

(f) a plurality of output select indicators positioned on the control panel one adjacent each output means; and (g) control means responsive to the actuation of the input select means and the output select means for creating the desired signal path between any selected input means and any selected output means, and for selectively causing the input select indicators and the output select indicators to glow by way of visual aid to the selective connection of the input means and the output means, the control means comprising:

(1) means for storing data indicative of whether or not the individual input means and the individual output means are selected by the input select means and the output select means at a current sampling moment;

(2) means for storing data indicative of whether or not the individual input means and the individual output means were selected by the input select means and the output select means at a previous sampling moment; and (3) means for comparing, at each sampling moment, the data stored at the current and the previous sampling moments in order to determine whether any of the input means and any of the output means are selected for creation of a signal path therebetween.

9. In a digital mixer, a signal path selector for selectively providing desired signal paths between a plurality of input terminals and a plurality of mixing modules, the signal path selector comprising:

(a) a control panel;

(b) a plurality of input terminals and a plurality of mixing module control means laid out on the control panel in prescribed arrangement;

(c) a plurality of input select pushbutton switches positioned on the control panel one adjacent each input terminal;

(d) a plurality of mixing module select pushbutton switches positioned on the control panel one adjacent each mixing module control means, the input select pushbutton switches and the mixing module select pushbutton switches being positioned so close to one another that any one input select pushbutton switch and any one mixing module select pushbutton switch are capable of concurrent one-hand, finger-pressure actuation to select one associated input terminal and one associated mixing module control means for creation of a signal path therebetween; and (e) control means responsive to the actuation of the input select pushbutton switches and the mixing module select pushbutton switches for creating the desired signal path between any selected input terminal and any selected mixing module to the exclusion of any preexisting signal path between the input terminals and the mixing modules that might interfere with the creation of the desired signal path, the control means comprising:

(1) means for storing data indicative of whether or not the individual input terminals and the individual mixing modules are selected by the input select pushbutton switches and the mixing module select pushbutton switches at a current sampling moment;

(2) means for storing data indicative of whether or not the individual input terminals and the individual mixing modules were selected by the input select pushbutton switches and the mixing module select pushbutton switches at a previous sampling moment; and (3) means for comparing, at each sampling moment, the data stored at the current and the previous sampling moments in order to determine whether any of the input terminals and any of the mixing modules are selected for creation of a signal path therebetween.

10. The signal path selector of claim 9 further comprising:

(a) a plurality of input select indicators positioned on the control panel one adjacent each input terminal; and (b) a plurality of mixing module select indicators positioned on the control panel one adjacent each mixing module control means;

(c) the control means being responsive to the actuation of the input select pushbutton switches and the mixing module select pushbutton switches for selectively causing the input select indicators and the mixing module select indicators to glow by way of visual aid to the selective connection of the input terminals and the mixing modules.

11. The signal path selector of claim 5 wherein said control means further comprises means for canceling, when any one input means and any one output means are selected for creation of a signal path therebetween, a preexisting signal path, if any, between the selected input means and any unselected output means and between any unselected input means and the selected output means.

12. The signal path selector of claim 7 wherein said control means further comprises means for canceling, when any one input means and any one output means are selected for creation of a signal path therebetween, a preexisting signal path, if any, between the selected input means and any unselected output means and between any unselected input means and the selected output means.

13. The signal path selector of claim 8 wherein said control means further comprises means for canceling, when any one input means and any one output means are selected for creation of a signal path therebetween, a preexisting signal path, if any, between the selected input means and any unselected output means and between any unselected input means and the selected output means.

14. The signal path selector of claim 9 wherein said control means further comprises means for canceling, when any one input means and any one output means are selected for creation of a signal path therebetween, a preexisting signal path, if any, between the selected input means and any unselected output means and between any unselected input means and the selected output means.

* * * * *

UNITED STATES PATENT AND TRADEMARK OFFICE

CERTIFICATE OF CORRECTION

PATENT NO. : 7,020,213 B2
APPLICATION NO. : 10/034830
DATED : March 28, 2006
INVENTOR(S) : Kunikata It is certified that error appears in the above-identified patent and that said Letters Patent is hereby corrected as shown below:

Column 10, Line 37, delete "$S_3$" and insert therefor -- $S_{31}$ --.

Signed and Sealed this

Seventeenth Day of October, 2006

JON W. DUDAS
*Director of the United States Patent and Trademark Office*